US006667683B1

(12) United States Patent
Emili et al.

(10) Patent No.: US 6,667,683 B1
(45) Date of Patent: Dec. 23, 2003

(54) PLANAR TRIMMING RESISTOR, APPLICATIONS AND METHOD FOR ITS MANUFACTURE

(75) Inventors: Walter Emili, Gomaringen (DE); Herbert Goebel, Reutlingen (DE); Harald Wanka, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 285 days.

(21) Appl. No.: 09/687,005

(22) Filed: Oct. 13, 2000

(30) Foreign Application Priority Data

Oct. 15, 1999 (DE) ..... 199 49 607

(51) Int. Cl.[7] ..... H01C 10/00
(52) U.S. Cl. ..... 338/195; 338/197; 338/211
(58) Field of Search ..... 338/195, 197, 338/211

(56) References Cited

U.S. PATENT DOCUMENTS 3,996,551 A * 12/1976 Croson ..... 338/309
4,150,366 A * 4/1979 Price ..... 340/247
4,200,970 A * 5/1980 Schonberger ..... 29/593
4,201,970 A * 5/1980 Onyshkevych ..... 338/195
4,586,988 A * 5/1986 Nath et al. ..... 204/15
4,947,020 A * 8/1990 Imamura et al. ..... 219/121.65
5,363,084 A * 11/1994 Swinehart ..... 338/308

FOREIGN PATENT DOCUMENTS

DE 2039920 * 2/1972

OTHER PUBLICATIONS

IBM Technical Disclosure Bulletin vol. 30 No. 4 Sep. 1987 p. 1571–1573.*

* cited by examiner

*Primary Examiner*—Lincoln Donovan
*Assistant Examiner*—K. Lee
(74) *Attorney, Agent, or Firm*—Kenyon & Kenyon

(57) ABSTRACT

A trimming resistor is manufactured by depositing a resistive layer on a substrate, with a passivation layer having windows, and a contact layer which is in contact with the resistive layer via the windows. Trimming is carried out by interrupting the contact layer at narrow spots or regions. This invention has application for the manufacture of high-pressure sensors.

3 Claims, 3 Drawing Sheets

PLANAR TRIMMING RESISTOR, APPLICATIONS AND METHOD FOR ITS MANUFACTURE

FIELD OF THE INVENTION

The present invention relates to a planar trimming resistor having a substrate and a resistive layer deposited thereon; a resistance bridge circuit and a sensor which make use of a trimming resistor of this kind; and a method for manufacturing the trimming resistor, the resistance bridge circuit, or the sensor.

BACKGROUND INFORMATION

Trimming resistors are used in circuits which are initially produced with a certain tolerance, and whose response is subsequently adjusted accurately by adjusting the resistance value of the aforementioned trimming resistors. Generally known are trimming resistors having a planar resistive layer whose resistance value can be adapted, subsequent to installing the trimming resistor in a circuit, by locally removing material of the resistive layer. In this context, the problem arises that a change in the resistance value by removing material of the resistive layer also influences the capacitance thereof, especially when the resistive layer extends in the immediate vicinity of a further conductor, for example, because the resistive layer is deposited on a metallic substrate in a manner that it is separated only by a thin insulating layer. Such a change in capacitance can destroy the value of the trimming if the response of the overall circuit is not only influenced by resistance value but also by the capacitance of the trimming resistor. This problem always arises when the trimming resistor is part of a resonant circuit.

SUMMARY OF THE INVENTION

The present invention provides a planar trimming resistor whose capacitance is not influenced by the trimming process.

This advantage is achieved in that a contact layer having a better conductivity than the resistive layer is arranged on the resistive layer so that it is in conducting contact with the latter at least at discrete or isolated locations, and in that the contact layer is accessible to an abrasive treatment at least locally. When the contact layer in such a trimming resistor is locally removed, then the result is that a current which would otherwise have flown through the contact layer, is deflected into the resistive layer at least partially so that the resistance value is increased in a controlled manner by removing the contact layer. However, since the resistive layer remains under the removed contact layer, the electrically conductive surface of the trimming resistor located opposite the substrate does not change and its capacitance is not changed by the removal process.

In principle, the contact layer can extend on the substrate beyond the boundaries of the resistive layer. However, those regions of the contact layer which are not lying above the resistive layer must not be removed since the surface of the trimming resistor would otherwise be reduced, thus unwantedly influencing the capacitance. To rule out problems of this kind, it is expedient for the contact layer to be dimensioned during the manufacture of the trimming resistor in such a manner that it does not extend beyond the edges of the resistive layer.

The contact layer and the resistive layer have preferably a strip-shaped design. Connection terminals are provided at opposed ends of the contact layer strip. The strips can be arranged on the substrate in a space-saving manner in a zigzag or meander form. The trimming resistor has preferably a passivation layer which essentially covers the resistive layer and has windows only locally which make the conductive contact of the contact layer with the resistive layer possible.

Between two windows of the passivation layer, in each case provision is preferably made for a narrow spot of the contact layer. At such a narrow spot, the contact layer can be cut through particularly easily; the cutting through of the contact layer resulting in that an electric current which would otherwise have flown through the contact layer must follow the path via the resistive layer between the two windows.

The passivation layer not only serves for protecting the resistive layer from environmental influences; its window pattern has the advantage that is sufficient for the contact layer to be cut through over a small length between two windows for extending the current path in the resistive layer; otherwise compared to this length a larger distance between two windows would be needed.

A preferred application of the trimming resistor is a resistance bridge circuit. In such a resistance bridge circuit, the resistor elements and the at least one trimming resistor are expediently formed above the same substrate. In this manner, the resistor elements and the trimming resistor can partly be manufactured using the same process steps.

A further preferred application of the trimming resistor is a sensor having a deformable substrate and at least one resistor element whose resistance value is variable by a deformation of the substrate, and to which a trimming resistor according to the present invention is allocated. This resistor element, in turn, can be part of a resistance bridge circuit.

The sensor can advantageously be a pressure sensor. The substrate can be part of a pressure capsule of such a pressure sensor.

Furthermore, the present invention relates to a method for manufacturing a trimming resistor, where a resistive layer is deposited and patterned on an insulating substrate, and where a contact layer having a better conductivity than the resistive layer is formed above the resistive layer, the contact layer being in contact with the resistive layer at least locally.

A passivation layer having windows for making the local contact is preferably deposited on the resistive layer prior to forming the contact layer. Suitable for patterning the different layers are photolithographic techniques, or, particularly advantageous in the case of sensors, are laser patterning techniques. In particular, the contact layer can be produced by sputter deposition of the layer material as well. It is also conceivable for the material of the contact layer to be directly deposited through a mask so that the contact layer is formed on the resistive layer (separated by the passivation layer) immediately in the desired shape.

The resistor is trimmed preferably by cutting through the contact layer between two windows, preferably using laser ablation. This laser ablation can be carried out using the same apparatuses which have possibly been used before for the laser patterning of the different layers.

DETAILED DESCRIPTION

Figure 1:
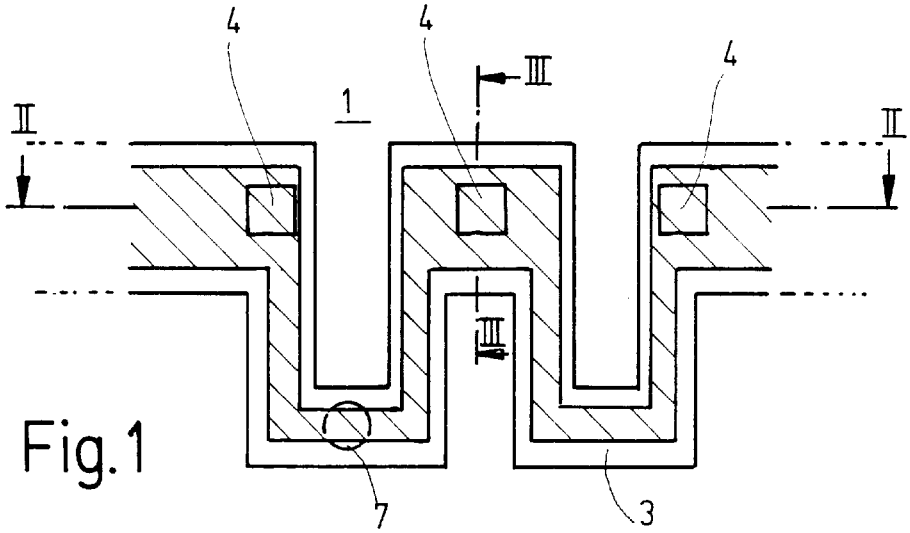
FIG. 1 shows a top view of a segment of a trimming resistor according to the present invention.
Figure 2:
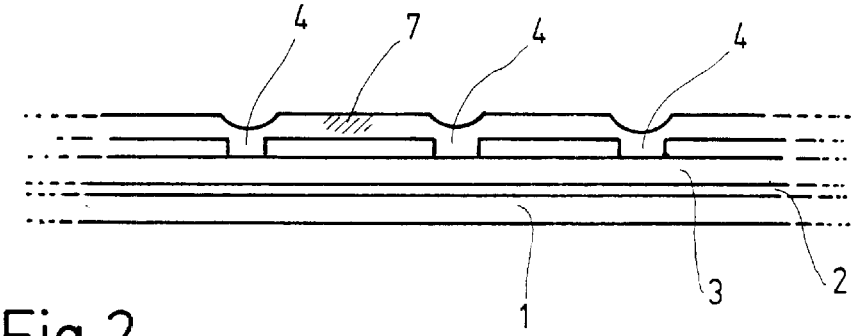
FIG. 2 shows the segment in a cross-section along line II—II from FIG. 1.
Figure 3:
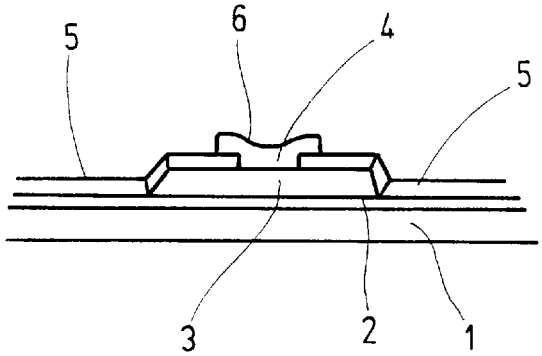
FIG. 3 shows a second cross-section along line III—III from FIG. 1.

FIGS. 1, 2 and 3 show a segment of a trimming resistor according to the present invention in a top view, and in two cross-sections, respectively. The trimming resistor is mounted on a substrate 1, in this case a sheet of high-grade steel, having an insulating layer 2, made of silicon oxide, thereon. The trimming resistor includes a resistive layer 3, which is made of a material having moderately good conductivity, and which forms a meander- or zigzag-shaped pattern on insulating layer 2, two periods of the pattern being shown in FIG. 1.

A passivation layer 5 is deposited on resistive layer 3, over its entire surface with the exception of discrete or isolated windows 4. The passivation layer is composed of silicon nitride or, as insulating layer 2, of silicon oxide. A contact layer 6, made of a metal having good electrical conductivity, in this case gold, follows the meander-like or zigzag-like course of resistive layer 3, but has a smaller width than the resistive layer 3, and is placed in such a manner that its edges do not project beyond the edges of resistive layer 3, anywhere. Contact layer 6 is in conducting contact with resistive layer 3 via windows 4.

Connection terminals (not shown) are located at the opposed ends of strip-like contact layer 6.

Since the conductivity of contact layer 6 is markedly better than that of resistive layer 3, a current applied via the connection terminals essentially flows through contact layer 6 in the untrimmed condition of the trimming resistor. To trim the resistor, provision is made for contact layer 6 to be cut through at a narrow spot, for example, region 7. Suitable for carrying out this cutting is the technique of laser ablation, in particular using an excimer laser. With these means, a laser energy irradiated upon region 7 can easily be quantitatively regulated in such a manner that contact layer 6 is removed at the respective location without concurrently damaging underlying resistive layer 3 as well. For this purpose, for example, the materials of contact layer 6 and of resistive layer 3, as well as the wavelength of the laser can be selected in such a manner that the ablation energy of contact layer 6 is lower than that of resistive layer 3 so that the energy of the excimer, even if it reaches resistive layer 3 subsequent to destroying contact layer 6, is not sufficient to destroy the resistive layer 3, as well. However, other, known methods for cutting, such as spark erosion, are usable as well.

The composition of passivation layer 5 can also serve as an aid for protecting resistive layer 3 from damage. Thus, by a suitable selection of the silicon content of passivation layer 5, it is possible for the penetration depth of the laser radiation to be adjusted in such a manner that the laser radiation is absorbed by passivation layer 5 across the overall thickness thereof, thus distributing its energy in the entire volume of the passivation layer 5. In comparison with that, the penetration depth of the radiation in the case of the metals or semiconductor materials of the contact layer 6, and of the resistive layer 3, respectively, is significantly smaller so that the heating of these layers, which is induced by the laser, is concentrated on a thin surface layer of these layers, and is sufficient to evaporate this surface layer.

When contact layer 6 is cut through at narrow spot 7, the current is forced to flow through resistive layer 3 between windows 4 neighboring narrow spot 7. By destroying contact layer 6 between a selectable number of windows 4, thus, the path length to be covered by the current in resistive layer 3, and consequently the resistance value of the trimming resistor, can be adjusted in steps very accurately.

Figure 4:
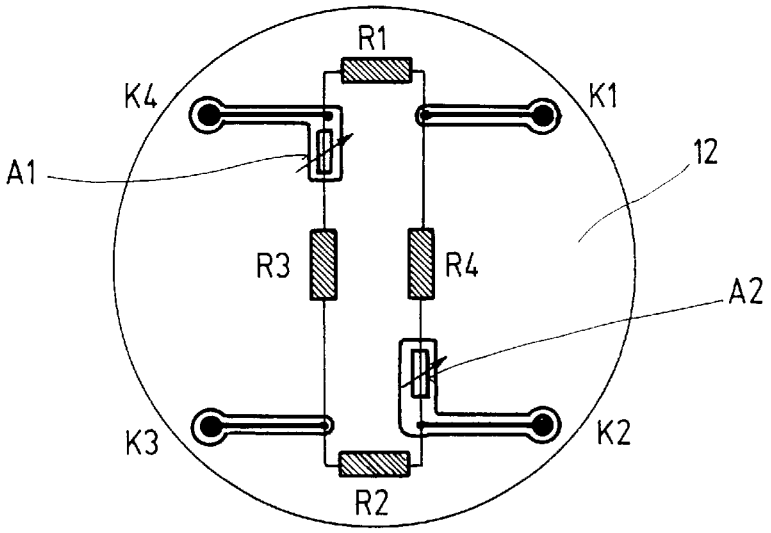
FIG. 4 shows a resistance bridge circuit having compensating resistors according to the present invention on a membrane of a pressure sensor.
Figure 5:
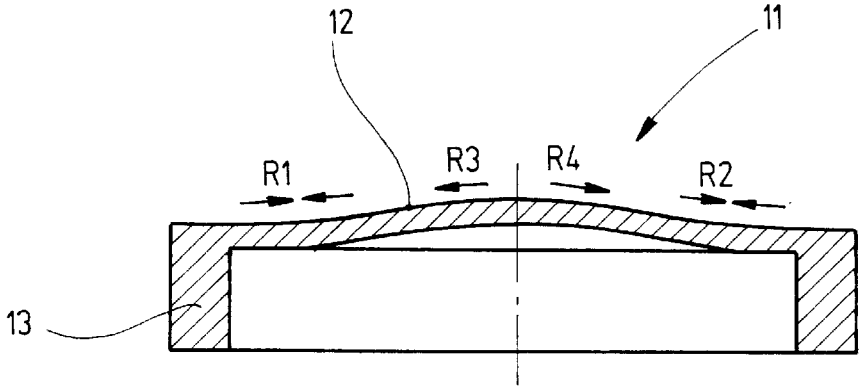
FIG. 5 shows a portion of the pressure sensor in a cross-section.

FIGS. 4 and 5 show a preferred example of application of the trimming resistor described above.

FIG. 4 is a top view of membrane 12 of a pressure sensor, the membrane 12, playing the role of substrate 1 in this case. On this membrane 12, four resistor elements R1, R2, R3, R4, having connections K1, K2, K3, K4, are interconnected to form a Wheatstone bridge. Trimming resistors A1, A2, of the type described with reference to FIGS. 1 through 3 are connected in series with resistor elements R3, R4. The resistor elements and the trimming resistors are produced on membrane 12 in a shared process which will be discussed later in greater detail; resistor elements R1, R2, R3, R4 have a resistive layer which corresponds to resistive layer 3 of the trimming resistors, however, the resistor elements have no continuous contact layer, and passivation layer 5 is continuous above resistor elements R1, R2, R3, R4 with the exception of their contact pads.

FIG. 5 shows membrane 12 of FIG. 4 in a cross-section. The membrane is part of a high-pressure sensor 11, and is integrally joined to a rigid metal frame 13. When a pressure difference exists between the two sides of membrane 12, then this results in a deformation of membrane 12 and, for example, if the pressure underneath the membrane is higher than above it, a compression takes place in the region of resistor elements R1 and R2, and an expansion occurs in the region of resistor elements R3 and R4, at the surface of the membrane 12. These deformations influence the conductivity of the resistive layers of the resistor elements, thus resulting in an unbalance of the Wheatstone bridge, which produces a measurement voltage which can be tapped at two of the connections K1 through K4, and which is different from zero.

For this application, it is expedient to select a material for the resistive layer which exhibits a marked dependence of the specific resistivity on the deformation. In this case, for example, polycrystalline silicon, chromium nickel alloys, or also platinum should be mentioned as suitable materials. In this context, NiCr-layers exhibit virtually no temperature dependence of the resistance but a relatively small effect during bending, whereas, polycrystalline silicon has a non-linear temperature dependence but, on the other hand, a significantly greater effect during bending. Platinum also exhibits a marked effect combined with a linear temperature dependence of the resistance. Suitable layer thicknesses lie in the range from 500 to 600 nm for polycrystalline silicon and from 50 to 100 nm for NiCr or platinum.

As a rule, the layer thicknesses should be selected in such a manner that the layer conductivity of the resistive layer is smaller than that of the contact layer, regardless of the specific conductivities of the materials used for these layers.

Figure 6:
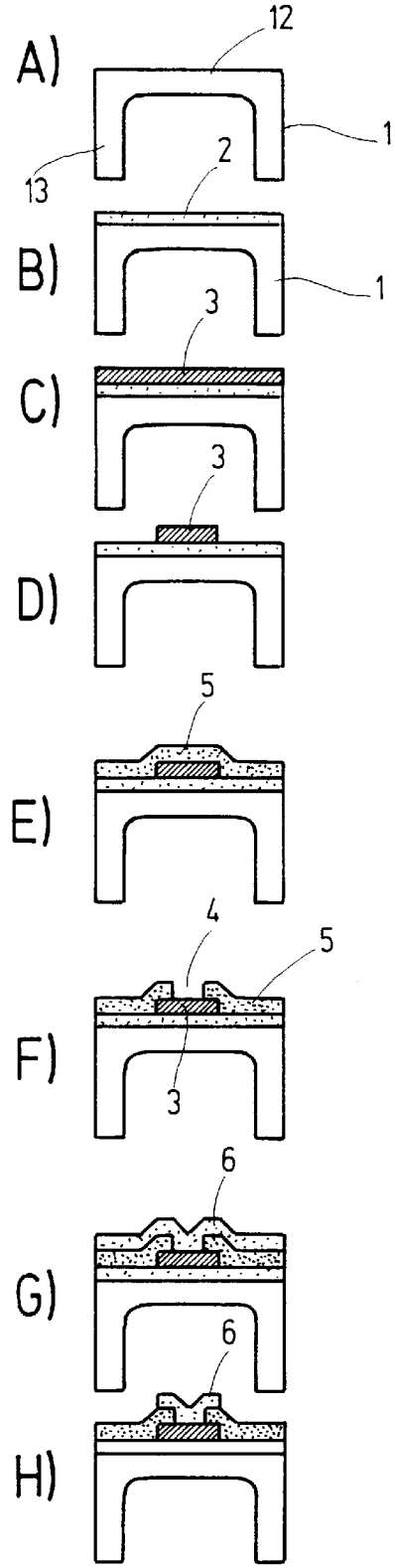
FIG. 6 shows the individual steps of the manufacturing process of the sensor of FIGS. 4 and 5.

The consecutive stages A through H of the method for manufacturing a trimming resistor according to FIGS. 1 through 3, or the sensor from FIGS. 4 and 5, which is equipped with trimming resistors A1, A2, are shown in FIG. 6. Stage A shows the still empty substrate 1 or the pressure capsule from FIG. 5, composed of frame 13 and membrane 12. This substrate is initially subjected to a receiving inspection for roughness, and is subsequently first wet-cleaned and then finish-cleaned by argon back cathode sputtering. Subsequently, the substrate treated in this manner is preheated to approximately 300° C. to prepare it for a PECVD oxide deposition. Then, insulating layer 2 is deposited from silicon oxide in a thickness of 7–10 $\mu$m. This insulating layer on the substrate is checked at random for thickness and stress.

Starting from coated substrate 1 (stage B), resistive layer 3 is deposited by cathode sputtering. The surface resistance is tested using the 4 point technique, and the layer thickness is determined using X-ray fluorescence (stage C).

Following is a patterning step in which the meander pattern shown in FIG. 1 is made from the resistive layer initially deposited over a large surface. For this patterning, a photolithographic technique or a laser patterning technique can be used. The photolithographic technique includes the deposition of a resist layer, the exposure of the resist to light in the desired pattern as well as its development, a chemical afteretching of those regions which have lost their resist layer due to the development, and finally, the removal of the remaining resist layer. Laser patterning is a particularly advantageous patterning technique. In the process, laser light of suitable energy density is irradiated through a mask onto the surface of the membrane. With the assistance of the depression on the rear of membrane 12 (see FIG. 5), it is possible for the sensor to be concentrically adjusted in a manner suitable for the patterning. Furthermore, the coated plane is automatically brought into the focal plane. The exposure to laser light through the mask causes the layer material which the laser radiation acts upon to be removed (ablated) so that the plurality of steps of the photolithographic technique may be omitted.

The level of absorption of the excimer radiation used in insulation layer 2 can be varied by adjusting a desired silicon content of the insulation layer. This makes it possible that radiation which reaches insulation layer 2 towards the end of the removal of resistive layer 3 is absorbed in a distributed manner across the entire thickness of the insulation layer and, in this manner, that the radiation does not reach the boundary surface between substrate and insulating layer, or that it does not reach the boundary surface in such an intensity that it could damage this boundary layer. Such a high-silicon oxide layer can be advantageously attained by a sputter-deposited silicon oxide layer, as well. Moreover, such a sputtered layer has the advantage that, in this manner, the resistive layer to be subsequently deposited obtains a higher long-term stability, because the resistive layer is thereby protected against the hydrogen which is usually built into PECVD oxide layers or nitride layers during deposition. As a logical consequence, a sputtered oxide layer should therefore be provided prior to passivating the resistive layer.

Stage (D) shows the substrate with already-patterned resistive layer 3.

At this stage, a visual inspection is carried out; subsequently, a passivation layer 5 is deposited (stage E). Thickness and stress of this layer are checked in a similar manner as in the case of resistive layer 3 in stage (C). Subsequently, an annealing takes place at a temperature of 350° C. For a subsequent patterning of passivation layer 5, a photolithographic technique or a laser patterning can be used again as already described for the patterning of resistive layer 3. In this patterning step, windows 4 are produced above the remaining pieces of resistive layer 3, respectively. Those pieces which are intended to form one of resistor elements R1, R2, R3, R4, receive two windows for leading through the connection terminals; those pieces which are intended to form trimming resistors Al, A2, receive a plurality of windows distributed over the surface thereof.

Already-patterned passivation layer 5 (stage F) is visually inspected.

In a subsequent step, contact layer 6 is deposited by cathode sputtering. Preferably used as material for contact layer 6 is gold in a layer thickness of 0.3 to 0.5 nm, also because of its stability against environmental influences. Possibly, however, a metallic adhesion layer and a further metal as diffusion barrier are also deposited thereunder in the same step. Aluminum or nickel are also possible as deposition materials. Subsequently, the thickness of contact layer 6 is checked using X-ray fluorescence.

For the subsequent patterning of contact layer 6, the photolithographic technique or the technique of laser patterning can be used again. The nominal dimensions of the contact layer regions which are intended to form the contact layer of the trimming resistors are selected in such a manner that, allowing for mask tolerances and other manufacturing inaccuracies, it is guaranteed that the contact layer remaining subsequent to patterning does not project beyond the edges of the underlying resistive layer anywhere. Because of these measures, it is guaranteed that the capacitance of the resistor elements and of the trimming resistors is determined exclusively by the surface area of their resistive layers 3, and that it cannot be influenced by possible inaccuracies during the positioning of the contact layers. Thus, it is possible for the bridge circuit to be manufactured with a high degree of symmetry of the capacitance of its individual branches. Consequently, the bridge circuit can be operated over a wide frequency range of input voltages, without unbalanced distributions of capacitance among the individual branches influencing the output voltage of the bridge circuit as a function of the frequency.

An alternative in the manufacture of contact layer 6 is the use of a "shadow mask" which, during the deposition of the material of the contact layer, leaves bare only those regions at the surface of the substrate where a contact layer is actually needed in the finished sensor. In this manner, the possibility exists for the patterning of the contact layer to be completely dispensed with; that is, stage (G) of the manufacture is skipped.

Stage (H) shows the sensor with already-patterned contact layer 6.

At this stage of manufacture, after full completion of all coating and patterning steps, the bridge circuit can be calibrated.

During the subsequent calibration of the resistance bridge, an input voltage is applied to diagonally opposed terminals, for example, K1, K3, of the bridge circuit, and an output voltage is measured at the two other outputs. If this voltage is different from zero, a calibration of the sensor is required which is carried out in that in one of the two trimming resistors A1, A2, regions of the contact layer such as region 7 from FIG. 1, are removed or destroyed in the value or number as is required for bringing the output voltage to zero. This local removal or destruction is carried out using an excimer laser. If the preceding patterning steps have already been carried out by laser ablation, the same laser can expediently be used for trimming. However, other, known methods for cutting, such as spark erosion, are usable as well.

The described method is excellently suitable for large-scale production of high-pressure sensors, since the manufacturing steps up to stage (H) can advantageously be carried out in a holding device for a great number of sensors at the same time without requiring steps to be carried out between times which require an individual treatment of the sensors; subsequent to the completion of the trimming, the sensor is completely ready without requiring further coating steps.

It is even possible for the sensor to be trimmed only when membrane 12 including metal frame 13 (FIG. 5) have been welded onto a pressure connection, which can possibly result in a slight unbalance of the resistor bridge.

What is claimed is:

1. A sensor comprising:

a deformable substrate;

at least one resistor element; and a trimming resistor in contact with the resistor element, the trimming resistor including:

a resistive layer deposited on the substrate; and a contact layer having a higher conductivity than the resistive layer being arranged on the resistive layer, being in conducting contact with the resistive layer at least at discrete locations, and being accessible to an abrasive treatment at least locally above the resistive layer, where the abrasive treatment is applied to the contact layer.

2. The sensor of claim 1, wherein the resistor element is part of a resistance bridge circuit.

3. The sensor of claim 1, wherein the substrate is part of a pressure capsule.

* * * * *